United States Patent [19]

Wasserman

[11] 4,290,260

[45] Sep. 22, 1981

[54] HIGH DENIER NON-PLIED FRIEZE YARN AND METHOD OF MAKING THE SAME

[75] Inventor: Allan Wasserman, Lincoln, R.I.

[73] Assignees: Felice Lowenstein, New York, N.Y.; Ronnee M. Wasserman, Providence, R.I. ; part interest to each

[21] Appl. No.: 107,405

[22] Filed: Dec. 26, 1979

[51] Int. Cl.[3] ..... D02G 3/12

[52] U.S. Cl. ..... 57/210; 57/16

[58] Field of Search ..... 57/13–18, 57/210, 225, 212

[56] References Cited

U.S. PATENT DOCUMENTS

| | | | |
|---|---|---|---|
| 1,526,918 | 2/1925 | Lipps | 57/16 |
| 3,382,655 | 5/1968 | Wasserman | 57/16 |
| 3,572,045 | 9/1970 | Wilson | 57/16 X |
| 3,675,409 | 7/1972 | Rosenstein | 57/16 X |
| 3,834,143 | 9/1974 | Menegatto | 57/16 |

FOREIGN PATENT DOCUMENTS

| | | | |
|---|---|---|---|
| 2004448 | 8/1971 | Fed. Rep. of Germany | 57/16 |

*Primary Examiner*—Donald Watkins
*Attorney, Agent, or Firm*—Salter & Michaelson

[57] ABSTRACT

A decorative composite non-plied frieze yarn for use in embroidering, sewing and the like. The composite yarn includes a core formed from a single plied frieze yarn having a spiral wrap of a decorative metallic yarn applied in a first rotational direction thereto and subsequently a non-metallic cover yarn spirally applied thereover in a second opposite direction. The single ply frieze core yarn itself includes a non-metallic core strand about which a first metallic strand is spirally wrapped in a first direction and subsequently about which a non-metallic cover yarn is wrapped in a second opposite rotational direction. Accordingly, the present composite frieze yarn includes three non-metallic strands and two metallic strands.

6 Claims, 1 Drawing Figure

HIGH DENIER NON-PLIED FRIEZE YARN AND METHOD OF MAKING THE SAME

BACKGROUND AND SUMMARY OF THE INVENTION

This invention relates to decorative frieze yarns of the type disclosed in a previous patent of applicant's, namely U.S. Pat. No. 3,382,655 issued May 14, 1968. Such decorative yarns have found wide spread use in the textile industry particularly for use in the formation of woven fabric materials. Frieze yarns formed by such patented process are characterized by a non-metallic core yarn about which a metallic cover yarn is spirally wrapped in a first direction and in turn about which a non-metallic cover yarn is spirally wrapped in the opposite direction to lock the first cover yarn in place. The first cover yarn thus characteristically includes a number of radially extending decorative loops of metallic strand so as to impart a rough, shaggy yet glittering texture to such frieze yarns.

In contrast to woven fabrics, relatively heavier denier or weight yarns are required for embroidering, hand weaving, sewing and the like. In order to arrive at such heavier weight yarns which have a frieze effect desirable for many applications, it has been common to ply two or more single frieze yarns together. Thus, if two of the frieze yarns formed by the process described in the aforementioned patent were applied together, a heavier denier frieze yarn having six separate strands or ends would be formed, that is, four strands of non-metallic core and cover yarn and two strands of metallic cover yarn. While certainly satisfactory for most uses, such multiple plied frieze yarn construction does however tend to flatten the laterally extending metallic loops of the single frieze yarns which gives the glitter and rough, shaggy texture to the yarns such that the overall result of the plied yarn is unacceptable in some cases.

It is accordingly an object of the present invention to provide a composite frieze yarn of an unplied construction such that the aforementioned undesirable flattening effect is avoided such that the full frieze effect may be retained with yarns of a heavier denier for use in embroidery, sewing, hand weaving and the like.

A further object of the present invention is the provision of the decorative composite frieze yarn set forth in the immediately proceeding object which is formed from fewer individual strands and accordingly enables a less costly product which nonetheless retains the desired decorative characteristics to be produced.

A still further object of the present invention is the provision of a novel method of forming a composite frieze yarn as set forth in the aforementioned objects which eliminates one of the steps formed in the currently utilized procedure wherein two or more single frieze yarns are plied together.

These and other objects of the present invention are accomplished by feeding a single frieze yarn of the type having a non-metallic core yarn about which a metallic yarn is initially spirally wound in a first rotational direction and thereafter about which a non-metallic cover yarn is spirally wound in a second opposite rotational direction in a generally longitudinal path to a first wrapping station, spirally wrapping a metallic yarn about said frieze yarn in said first rotational direction at said first station, thereafter directing said frieze yarn to a second wrapping station displaced longitudinally downstream from said first station, spirally wrapping a non-metallic cover yarn about said frieze yarn in said second direction and subsequently taking up the composite frieze yarn thus formed.

Other objects, feature and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
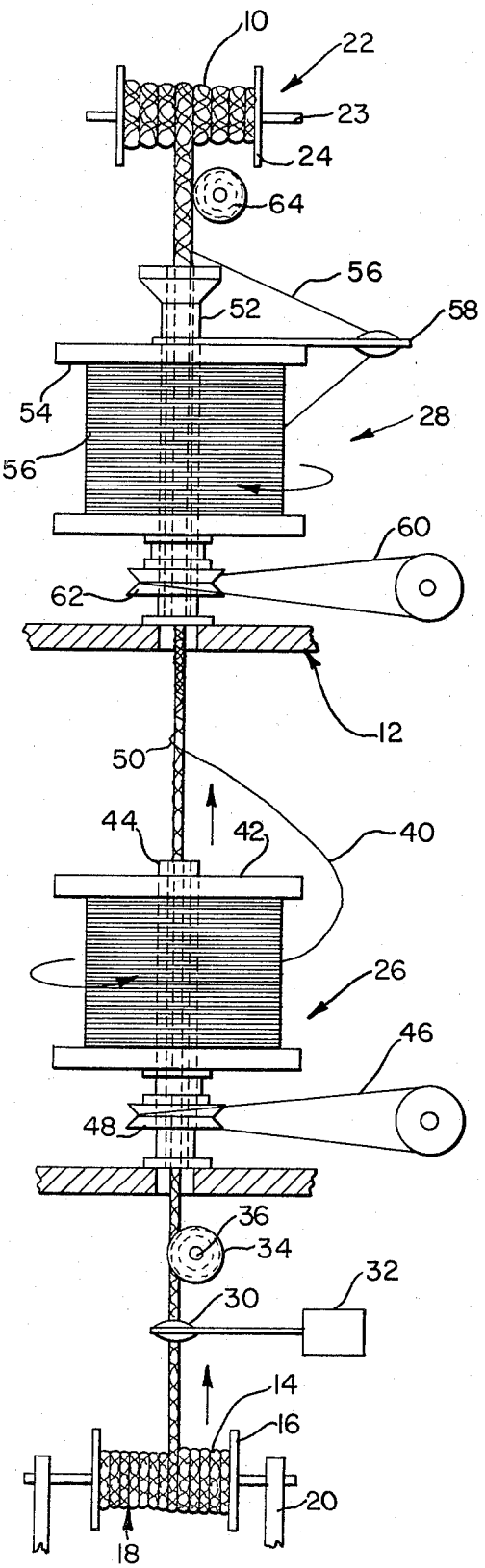
FIG. 1 is a side elevational view in somewhat schematic form of the apparatus utilized to form the decorative composite frieze yarn of the present invention.

Turning now to FIG. 1 of the drawing, the apparatus and method through which the novel composite non-plied decorative frieze yarn 10 of the present invention is formed is illustrated. Such figure shows a single station of a multiple modified construction spinning frame 12 wherein the decorative composite yarn of the present invention may be formed in an upward step-wise progression. Therein a supply of single frieze yarn 14 wound on a spool 16 so as to form a package 18 is supported for free rotation on a stand 20. Such single frieze yarn 14 includes a non-metallic core yarn about which a metallic yarn is wrapped in a first rotational direction and subsequently about which a non-metallic cover yarn is wrapped in a second opposite rotational direction. The resultant structure of such single frieze yarn as well as the manner and apparatus for forming such is disclosed in applicant's previous U.S. Pat. No. 3,382,655 issued May 14, 1968, the disclosure of which is hereby specifically incorporated by reference into the subject specification.

Such frieze yarn 14 may be characterized in having a shaggy and rough textured appearance primarily formed by the presence of a plurality of laterally, i.e. radially extending longitudinally spaced loops of the decorative metallic yarn wound about the core yarn and held in place by the spiral wrap of the cover yarn. In essence, the present process utilizes such frieze yarn as the core yarn in a wrapping process as described in the aforementioned Wasserman patent. Thus, instead of conventionally plying two or more of the resultant single frieze yarns 14 of the previously described Wasserman patent to form a composite heavier denier frieze yarn suitable for use in embroidery, hand weaving, sewing and the like which undesirably results in a certain amount of flattening of the metallic yarn loops of such repective single frieze yarns, the present process results in a composite frieze yarn 10 which retains a high degree of decorative luster and bulk. The present process accomplishes such not only in conjunction with the elimination of one of the non-metallic core yarns present in the prior art composite plied structure above referred to but also with an attendant elimination of the aformentioned described prior art plying process. Accordingly, a take up spool 24 is initially threaded with single frieze yarn through first and second wrapping stations 26 and 28 respectively such that the single frieze yarn 14 moves upwardly from spool 16 through a guide eyelet 30 extending from a guide support 32 and thence passes over a star wheel 34 rotating on a horizontal shaft 36. A series of spools 24, one for each take up station are mounted on a common shaft 23.

The upwardly moving single frieze yarn 14 is then wrapped with a metallic yarn 40 supported on a spool 42 which in turn is mounted on a tubular spindle 44 arranged for rotation about its vertical axis by a belt 46 operatively associated with a drive pulley 48 in turn connected to the spindle 44. The metallic yarn 40 feeds freely from the rotating spool 42 so as to cause a baloon-ing effect as shown in FIG. 1 and is accordingly wrapped about the upwardly moving single frieze yarn 14 in a spiral fashion so as to form a series of laterally extending longitudinally separated loops 50 of metallic yarn as previously explained in conjunction with the formation of the single frieze yarn 14. The metallic yarn is of a conventional type ranging from 0.01 of an inch to about 1/32 of an inch and is generally a synthetic resin fiber strand or band that has been provided with a metal coating by procedures as are known in the art.

The single frieze yarn 14 with the spiral wraps of metallic yarn 40 applied thereto subsequently upwardly passes into the second wrapping station 28 where it is directed through a second rotating spindle 52 on which a spool 54 is mounted. Such spool 54 includes a supply of cover yarn 56 which may be a single or multiple strand synthetic yarn such as rayon, nylon, polyester or the like and preferably may have a denier of about 70 to about 300. The cover yarn 56 passes from the rotating spool 54 through a flyer 58 of conventional construction and thence is wrapped in a second spiral direction opposite to the first rotational direction around the partially completed frieze yarn as it passes upwardly through the apparatus 12. The flyer 58 tensions the cover or locking yarn 56 and thus avoids the loops 50 formed when the yarn 40 is allowed to baloon about the frieze yarn 14. In this regard, a belt 60 is trained over a drive wheel 62 in turn connected to the spindle 52. This in effect, enables the cover yarn 56 to lock the metallic yarn 40 in place upon the single frieze yarn 14. The resultant frieze yarn 10 then moves upwardly about a star wheel 64 and thence to the take up roll 24 in turn adapted to rotate upon the shaft 23 common to the plurality of take up stations 22 normally provided.

It accordingly may be appreciated that the second metallic yarn 40 as well as the cover or locking yarn 56 subsequently applied to the resultant yarn 10 in part accomplishes the desired decorative effect without undue flattening or the metallic loops 50 already present in the single frieze yarn 14. This is in contrast to the substantial flattening effect of the individual loops when two or more single frieze yarns are plied together in accordance with the presently utilized method of forming the heavier denier bulk type frieze yarns desirable for use in embroidery, hand weaving, sewing and the like.

The present process also, as above noted, substantially reduces the amount of yarn handling normally required in the prior art multiple plied process. In this regard, it should be noted that in such plying process it is customary to rewind a single frieze yarn 14 such as formed as a result of the process disclosed in the previous Wasserman patent from its normal takeup spool to a separate spool to be utilized in the plying procedure. In the present process, only a single respooling or rewinding step is required—that of moving the single frieze yarn from its normal take up roller to the supply roller 16. Also there is a significant savings in machine operational time since the separate plying operation is eliminated, that is, in such prior art plying procedure, two separate machine passes or one of twice the time duration is required to form the necessary separate single frieze yarns for the plying procedure whereas in the present process two passes through the device 12 of the illustrated apparatus accomplishes the final result desired.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. The method of forming a relatively heavy composite metallic frieze yarn suitable for use in embroidery, sewing and the like comprising, feeding a single ply frieze yarn of the type having a non-metallic core yarn about which a metallic yarn is initially spirally wound in a first rotational direction and thereafter about which a non-metallic cover yarn is spirally wound in a second opposite rotational direction in a generally longitudinal path to a first wrapping station, spirally wrapping a metallic yarn about said frieze yarn in said first rotational direction at said first station, thereafter directing said frieze yarn to a second wrapping station displaced longitudinally downstream from said first station, spirally wrapping a non-metallic cover yarn about said frieze yarn in said second direction and subsequently taking up the non-plied composite frieze yarn thus formed.

2. The method of claim 1 wherein both said metallic yarns and said cover yarns are single strands.

3. The method of claim 2 wherein both said non-metallic and said cover yarns are formed of synthetic resin fibers.

4. A relatively heavy non-plied decorative metallic, composite frieze yarn suitable for use in embroidery, sewing and the like comprising a composite core yarn including a non-metallic core yarn about which a first metallic yarn is spirally wound in a first rotational direction and over which a first non-metallic cover yarn is spirally wound in a second opposite rotational direction, said composite core yarn having a second metallic yarn spirally wrapped thereover in one rotational direction and a second non-metallic cover yarn spirally wrapped thereover in a second direction opposite to that of said one rotational direction.

5. The composite frieze yarn of claim 4, wherein said first and said one rotational directions are the same.

6. The composite frieze yarn of claim 5, wherein said core yarn and said cover yarns are of the same material and said metallic yarns are of the same material.

* * * * *